US009194196B2

(12) United States Patent
Nott

(10) Patent No.: US 9,194,196 B2
(45) Date of Patent: Nov. 24, 2015

(54) DUAL PURPOSE MUD-GAS SEPARATOR AND METHODS

(71) Applicant: Canrig Drilling Technology Ltd., Houston, TX (US)

(72) Inventor: Darcy Nott, The Woodlands, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 193 days.

(21) Appl. No.: 13/964,518

(22) Filed: Aug. 12, 2013

(65) Prior Publication Data

US 2015/0040755 A1 Feb. 12, 2015

(51) Int. Cl.

| | |
|---|---|
| ***B01D 19/00*** | (2006.01) |
| ***E21B 21/06*** | (2006.01) |
| ***E21B 21/01*** | (2006.01) |

(52) U.S. Cl.

CPC ..... *E21B 21/067* (2013.01); *E21B 21/01* (2013.01)

(58) Field of Classification Search

CPC ..... B01D 19/00; B01D 19/0057; B01D 19/0063; E21B 21/067; E21B 21/00; E21B 21/06

USPC ..... 96/160, 195

See application file for complete search history.

(56) References Cited

U.S. PATENT DOCUMENTS

| | | | | |
|---|---|---|---|---|
| 4,294,593 | A * | 10/1981 | Rehm | 96/160 |
| 4,852,395 | A * | 8/1989 | Kolpak | 73/61.44 |
| 5,116,515 | A | 5/1992 | Selesnick | |
| 6,389,878 | B1 | 5/2002 | Zamfes | |
| 6,391,094 | B2 * | 5/2002 | Ramos | 95/248 |
| 6,926,101 | B2 | 8/2005 | deBoer | |
| 2008/0190668 | A1 | 8/2008 | Swartout | |
| 2010/0200242 | A1 | 8/2010 | Rodger et al. | |
| 2012/0318529 | A1 * | 12/2012 | Herrold et al. | 166/375 |

FOREIGN PATENT DOCUMENTS

| | | |
|---|---|---|
| EP | 0024148 | 2/1981 |
| WO | WO 94-05393 | 3/1994 |

OTHER PUBLICATIONS

International Search Report and Written Opinion issued for PCT/US2014/046826 dated Nov. 6, 2014, 15 pgs.

* cited by examiner

*Primary Examiner* — Duane Smith
*Assistant Examiner* — Minh-Chau Pham
(74) *Attorney, Agent, or Firm* — Haynes and Boone, LLP

(57) ABSTRACT

A mud-gas separator is arranged for both well control and drilling process. In some aspects, the mud-gas separator includes a main vessel including a bottom portion and a side portion. The mud-gas separator also includes a gas vent associated with the main vessel and configured to vent gas from well returns introduced into the main vessel. It also includes a first mud outlet formed within the bottom portion of the main vessel and configured to pass mud from well returns introduced into the main vessel and includes a second mud outlet formed within the side portion of the main vessel and configured to pass mud from well returns introduced into the main vessel.

21 Claims, 4 Drawing Sheets

DUAL PURPOSE MUD-GAS SEPARATOR AND METHODS

BACKGROUND OF THE DISCLOSURE

Some underground drilling processes require that operators circulate drilling fluid, known as mud, to a bottom hole assembly cutting through subterranean formations. The mud, along with cuttings from the drilling process, flow back up the wellbore to the surface. The mud is cleaned, and cuttings are removed before recirculating the mud back down into the wellbore.

Gas encountered while drilling becomes mixed in the mud and is carried to the surface within the mud. When operators are aware that mud contains gas, the mud is typically directed to a separator before the mud is cleaned and recirculated. Since the separator may complicate the recirculating process, it is typically brought on-line only when gas is known to be in the mud. This knowledge, however, is typically gained only after compressed gas has been released from the return line at the shakers, causing an alarm and potential hazard as the gas escapes the confines of the return pipes.

The present disclosure is directed to systems and methods that overcome one or more of the shortcomings in the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
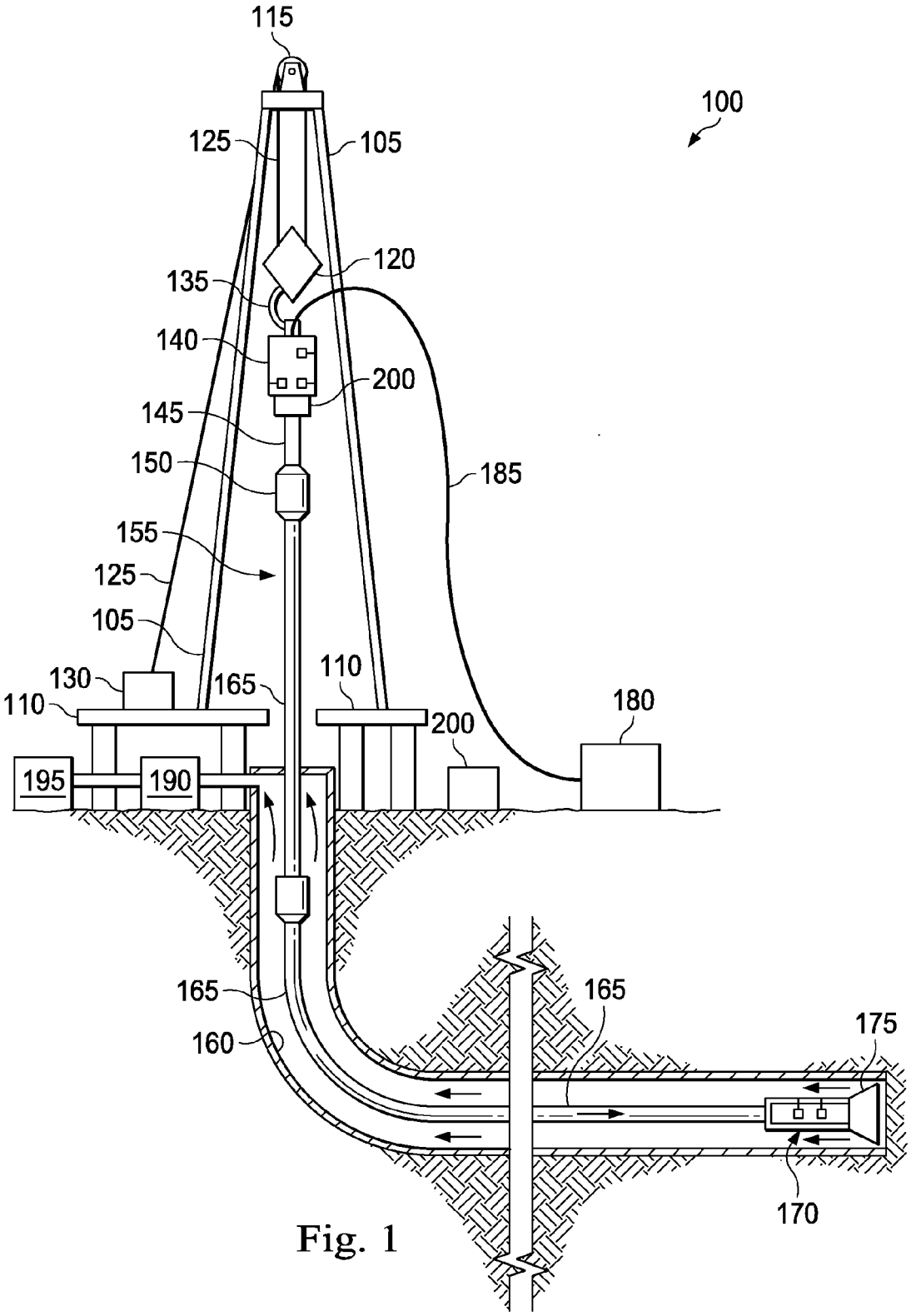
FIG. 1 is an illustration of an apparatus as a drilling rig according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure is directed to apparatuses and methods having a unique arrangement that separates gas from mud of well returns. The apparatus disclosed herein may enable continuous mud-gas separation during drilling, and is suitable for use in traditional well control conditions when return flow unexpectedly deviates, which can occur in a variety of situations, for example, during managed pressure drilling operations. The apparatus is arranged with a redundant, secondary outlet to be used when, for example, a primary outlet becomes plugged or the apparatus becomes flooded, as may occur during well control conditions. The shape and arrangement of the apparatus may permit it to be used not only when compressed gas is known to be contained within the mud, but also be used continuously during drilling to separate mud and entrained gas from well returns. This may result in more efficient mud-gas separation with a decreased chance of inadvertent gas release. In addition, some embodiments of the apparatus are instrumented to indicate performance and to identify and rectify problems. Accordingly, the apparatus disclosed herein has a dual purpose because it is used as a separator for unconventional drilling processes and for conventional well control processes.

Referring to FIG. 1, illustrated is a schematic view of an apparatus 100 demonstrating one or more aspects of the present disclosure. The apparatus 100 in the example shown is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

The apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel out and reel in the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 may be attached to a saver sub 150, which is attached to a drill string 155 suspended within a wellbore 160. Alternatively, the quill 145 may be attached to the drill string 155 directly. It should be understood that other conventional techniques for arranging a rig do not require a drilling line, and these are included in the scope of this disclosure.

The drill string 155 includes interconnected sections of drill pipe 165, a bottom hole assembly (BHA) 170, and a drill bit 175. The bottom hole assembly 170 may include stabilizers, drill collars, and/or measurement-while-drilling (MWD) or wireline conveyed instruments, among other components. The drill bit 175, which may also be referred to herein as a tool, is connected to the bottom of the BHA 170 or is otherwise attached to the drill string 155. One or more pumps 180 may deliver drilling fluid to the drill string 155 through a hose or other conduit 185, which may be fluidically and/or actually connected to the top drive 140. This embodiment includes a system 200 that may be referred to as a telescoping washpipe system disposed between the top drive 140 and the quill 145. The system 200 is described more fully further below.

Still referring to FIG. 1, the top drive 140 is used to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others, alone or in combination with a top drive 140.

A mud-gas separator 190 and one or more shakers 195 connect to the wellbore 160. The mud-gas separator 190 is configured to receive well returns, including mud, cuttings, and gas, from the wellbore 160 and to remove the gas from the mud in a controlled manner. The mud flows to the shakers 195 that separate solids from liquids by utilizing a vibrating system outfitted with specially designed and sized screens. The shakers 195 remove drilled solids and well cuttings returned from the wellbore during the drilling process. The flow of mud is represented by arrows shown the wellbore 160. Clean mud is pumped from the surface down through the drill string 165 as represented by the arrow within the drill string 165 adjacent the BHA 170. The mud then flows from the bottom of the wellbore 160 toward the surface, carrying cuttings and material, including gas, from the bottom of the wellbore 160. The mud, the cuttings, and any other material make the well returns. At the surface, the well returns are captured at the wellbore head and sent to the mud-gas separator 190 or shakers.

The apparatus 100 also includes a control system 200 configured to control or assist in the control of one or more components of the apparatus 100. For example, the control system 200 may be configured to transmit operational control signals to the drawworks 130, the top drive 140, the BHA 170 and/or the pump 180, and the mud gas separator 190. The control system 200 may be a stand-alone component installed near the mast 105 and/or other components of the apparatus 100. In some embodiments, the control system 200 is physically displaced at a location separate and apart from the drilling rig.

Figure 2:
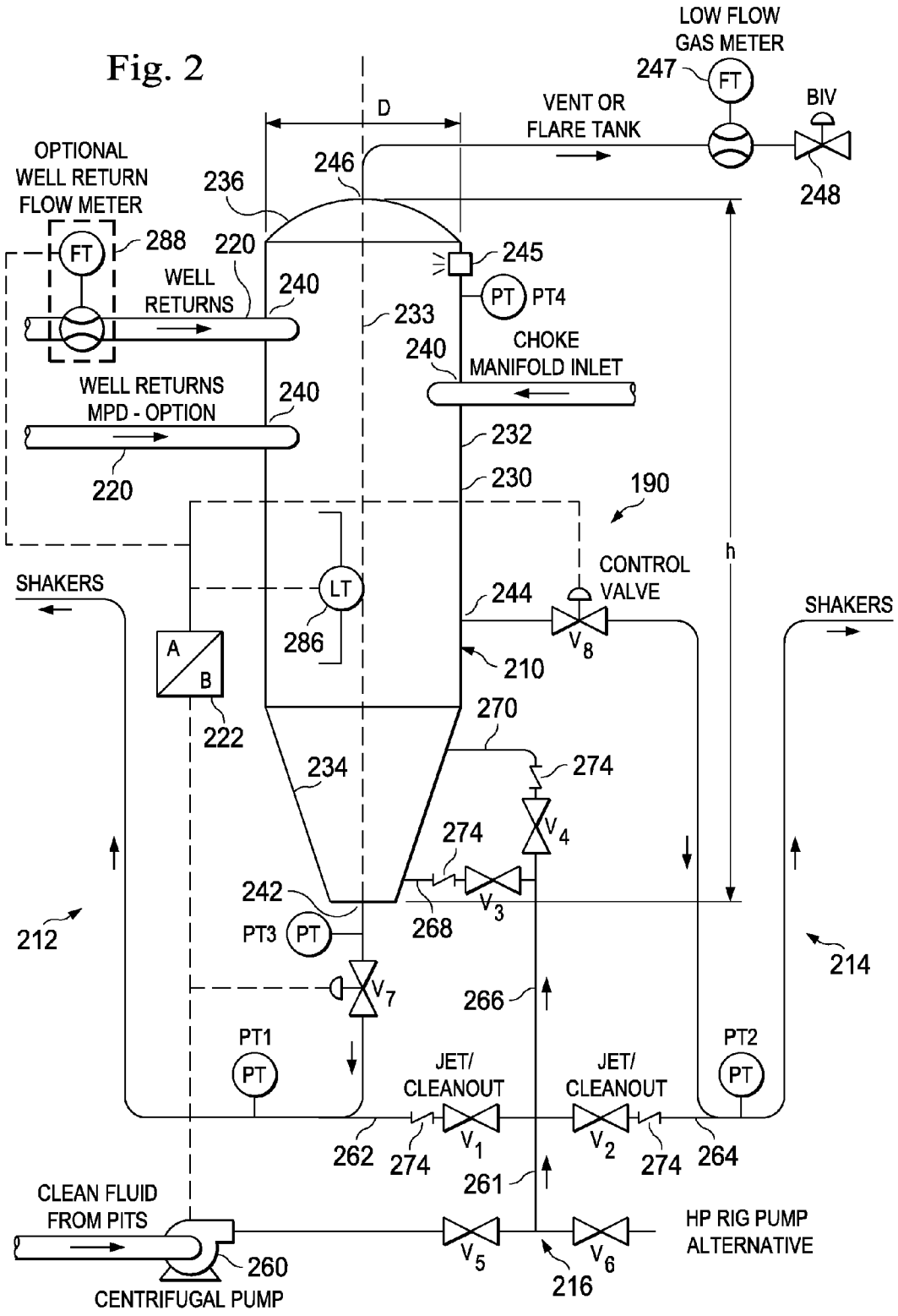
FIG. 2 is a diagram of an apparatus as a mud-gas separator according to one or more aspects of the present disclosure.
Figure 3:
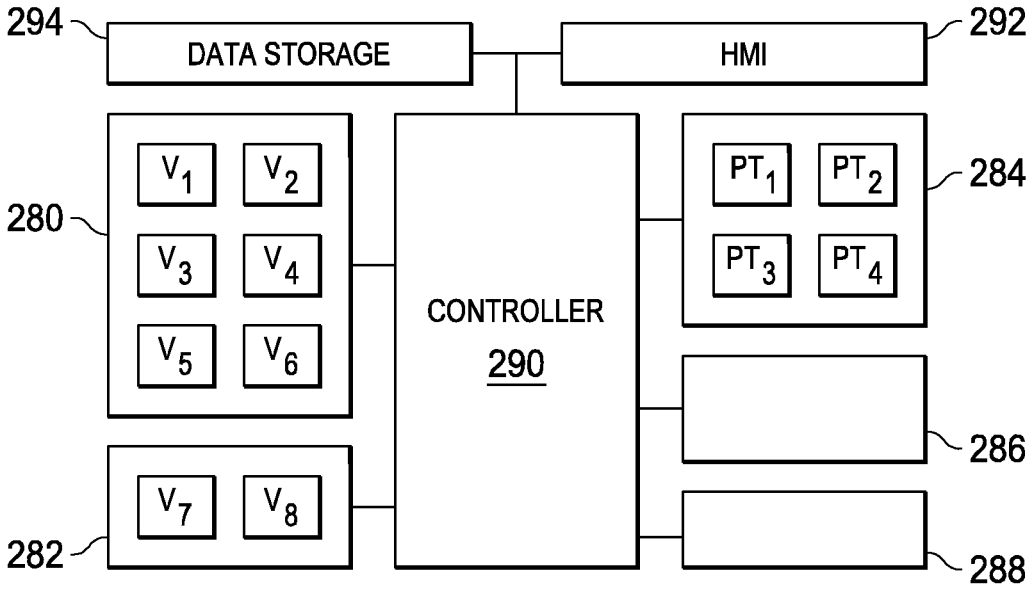
FIG. 3 is a block diagram of an apparatus as a sensing and control system of the mud-gas separator according to one or more aspects of the present disclosure.

FIG. 2 shows a stylized illustration of a schematic of the mud-gas separator 190, also referenced as an apparatus. The mud-gas separator 190 includes a hollow main vessel 210, a primary U-tube 212, a secondary U-tube 214, a sparge system 216, one or more input lines 220, and a sensing and control system 222 (FIG. 3).

The main vessel 210 includes a chamber wall 230 having a shell or body portion 232, a frusto-conical portion 234, and a head 236. In the embodiment shown, the body portion 232 is a cylindrically shaped portion. The frusto-conical portion 234 extends downwardly from the body portion 232 and forms a funnel. The head 236 is disposed on the upper end of the body portion 232. In various embodiments, the main vessel 210 (including body portion 232, frusto-conical portion 234, and head 236) is sealed and under pressure, which pressure is controlled by managing the various inflows and outflows as described herein. The main vessel 210 forms or includes a chamber that serves as a separation zone where returned gas may separate from returned drilling mud. Accordingly, the main vessel 210 also may be a pressure vessel that receives drill returns therein.

The body portion 232 is the main body of the main vessel 210 and, in the embodiment shown, is a cylindrical portion having a central axis 233 and having an axial height h greater than its diameter d. In some embodiments, the body portion 232 is not cylindrical, but may be oval, spherical, rectangular, or other shape in cross-section. In various embodiments, the cross-sectional shape is symmetric about the central axis 233 to facilitate the flow of the fluids therein. The frusto-conical portion 234 extends from the bottom of the body portion 232 and forms a funnel portion shaped to ease discharge of mud and cuttings from the main vessel 210. As such, it includes a wall that tapers inwardly to direct mud from the main vessel 210 toward a bottom end of the main vessel 210. The head 236 is disposed at the top of the body portion, covers and maintains the body portion 232, and in various embodiments seals or caps the main vessel 210.

The hollow main vessel 210 also includes a well return inlet 240, a primary mud outlet 242, a secondary mud outlet 244, and a gas vent 246. The well return inlet 240 connects to the input line 220, which connects either directly or indirectly to the wellbore 160 in FIG. 1. The well returns include mud, gas, cuttings, and any other matter returned from the wellbore. The well returns flow into the main vessel 210 through the well return inlet 240. In the embodiment shown, the well return inlet 240 is formed in the wall of the body portion 232. In this example, it is disposed at a height greater than both the primary and secondary mud outlets 242, 244. Although it is shown disposed in the upper half of the body portion 232, in other embodiments, the well return inlet 240 is disposed elsewhere in the system, including through the head 236. The well return inlet 240 may include multiple inlet ports for the well returns. There may be additional inlets. Here, there are multiple inlets, including the inlet 240 from a choke manifold (not shown). Other inlets may connect with secondary managed pressure drilling components.

The main vessel 210 may also include additional elements that assist in the separation of gas from mud. For example, some embodiments include mechanical gas breakers, cyclonic separators, baffle plates, or other agitators associated with the inlet 240 of otherwise disposed within the main vessel 210. The agitators may be used to help separate gas from mud. Other agitator devices or technologies may also be employed.

In the exemplary embodiment shown, the main vessel 210 includes one or more internal spray nozzles 245. These are configured to mistify and disperse chemicals, fluids, or gas to aid in separation of mud and gas or to aid in maintenance of the mud-gas separator 190.

The primary mud outlet 242 is disposed at a bottom end of the frusto-conical portion 234. The primary u-tube 212 connects to the primary mud outlet 242 and is configured to receive mud and cuttings of the well returns that pass through the frusto-conical portion 234. In some embodiments, the outlets 242, 244 include a velocity breaker.

The secondary mud outlet 244 is disposed in the body portion 232 at a location above the frusto-conical portion 234 and below the well return inlet 240. The secondary mud outlet 244 connects to the secondary u-tube 214 and passes mud and cuttings of the well returns when the level of mud and cuttings in the chamber is sufficiently high. In the exemplary embodiment shown, the secondary mud outlet 244 is disposed in the lower half of the body portion 232, however, in other embodiments, it is included on the frusto-conical portion 234.

The gas vent 246 extends from the upper portion of the main vessel 210, and in this embodiment, extends from the head 236. Other embodiments may include the gas vent 246 at an upper portion of the body portion 232. The gas vent 246 may vent to the atmosphere, or may connect via a tube or carrier to a flare tank pit or other location about the rig apparatus 100. Some embodiments include a demister mesh or mechanical demister associated with the gas vent 246. The size of the main vessel and the sizes of the primary and secondary u-tubes 212, 214 may be determined based upon the drilling application since the mud-gas separator 190 is designed to balance the expected well returns and gas separation with a sufficient fluid flow to ensure the cuttings progress through the entire primary or secondary u-tubes 212, 214. In some aspects, a suitable balance can be achieved in the main vessel 210 by controlling the inflow of well returns and the outflow of gas through the gas vent 246 and the cuttings, mud, and other solids or semi-solids through the primary and secondary mud outlets 242, 244.

In the exemplary embodiment shown, a gas meter 247 is disposed along a vent conduit or at the gas vent 246 to measure or quantify gas obtained from the drilling mud. In some embodiments, this is a low-flow gas meter. This enables rig operators to track gas volume vented during drilling. This may also provide rig operators with totalizer values, which are often tracked as the total volume of gas retrieved during a well drilling process for a single well. This information may be recorded or stored in the control system 200 or elsewhere about the rig or remotely through a network connection. The gas meter 247 can also be used for production flow checks on producing zones.

Some embodiments include a back pressure control valve 248 on the gas vent 246. This allows the mud-gas separator 190 to be used in a pressurized gas separation mode. This may find particular utility during well testing or underbalanced drilling.

The primary u-tube 212 extends from the primary mud outlet 242 at the bottom of the frusto-conical portion 234. As understood by its name, it is formed generally as a u-shape extending substantially vertically downward from the primary mud outlet 242 to a u-shaped curve and then extends primarily vertically upward. The primary u-tube 212 leads to the shakers 195 (FIG. 1) and is configured to convey mud, cuttings, and any other solids from the main vessel 210 for processing at the shakers 195. The u-tube length is sized to meet the expected gas head pressure requirements and provide a fluid seal to rig equipment.

The secondary u-tube 214 extends from the secondary mud outlet 244 and extends in a direction substantially vertically downward to a u-shaped curve and then extends substantially vertically to an upward height. The secondary u-tube 214 also leads to the shakers 195 (FIG. 1).

The sparge system 216 is configured and arranged to flush solids and to force mud through the primary and secondary u-tubes 212, 214. It is configured to at least keep solids from collecting, to unplug any blockage, or to add extra fluid for cuttings transport, or any combination thereof. In the embodiment shown, the sparge system 216 includes a high pressure pump 260 and a series of flow lines leading to different aspects of the mud-gas separator 190. The pump 260 may be any type of pump, and in some embodiments, is a centrifugal pump. In may be fluidicly connected to a fluid source, such as clean fluid from the drilling pits at the rig site. As can be seen, the series of flow lines includes a main line 261, a primary flow line 262 connecting to the primary u-tube 212, a secondary flow line 264 connecting to the secondary u-tube 214, and a chamber flow line 266. The pump 260 may be controlled by the sensing and control system 222 to flush solids and mud through the mud-gas separator 190.

The primary flow line 262 is directed to intersect the bend forming the u-shape of the primary u-tube 212 so that a portion of an axis of the primary u-tube 212 and a portion of an axis of the primary flow line 262 coincide. In other embodiments, however, the primary u-tube 212 and the primary flow line 262 intersect at any acute angle, and in some embodiments, the angle is between 0 and 30 degrees. The primary flow line 262 may be arranged to permit access to the bottom of the line 262 for cleanout. Some embodiments include an internal jetting mechanism to aid in plug removal.

The secondary flow line 264 is directed to intersect the bend forming a u-shape of the secondary u-tube 214 so that a portion of an axis of the secondary u-tube 214 and a portion of an axis of the secondary flow line 264 coincide. Like the primary u-tube 212 and the primary flow line 262 discussed above, the secondary u-tube 214 and the secondary flow line 264 intersect at any acute angle, and in some embodiments, the angle is between 0 and 30 degrees. The secondary flow line 264 may be arranged to permit access to the bottom of the line 264 for cleanout. As mentioned above, some embodiments include an internal jetting mechanism to aid in plug removal.

The chamber flow line 266 connects to the main vessel 210 and is configured to introduce high pressure flow or high fluid volume into the main vessel 210 to assist with flow from the main vessel 210, to assist with cleaning of the main vessel 210 or to remove a clog or build-up that may affect flow from the main vessel 210. In the example shown, the chamber flow line 266 includes a frusto-conical portion line 268 and a body portion line 270. The frusto-conical portion line 268 intersects the frusto-conical portion 234 and is disposed to introduce fluid into the frusto-conical portion 234 at a location above the primary mud outlet 242. The frusto-conical portion line 268 may be disposed to provide a nozzle jetting effect, a cyclone effect, or both, on the frusto-conical portion 234 to help clean sides of the frusto-conical portion 234 and to help move along the mud and cuttings. This may be done as a part of routine maintenance or may be done in response to a low flow or high flow condition. The body portion line 270 intersects the body portion 232 of the main vessel 210. It also is disposed to clean sides of the body portion 232 and to help move along the mud and cuttings. The frusto-conical portion line 268 may also include internal piping and nozzles to aid in cleaning and fluid movement. In some embodiments, these may be disposed in alternate locations, including about the main vessel.

The input line 220 extends to an upper portion of the main vessel 210 and is in fluid communication with the wellbore so that mud, cuttings, and gas from the wellbore are directed into the main vessel 210 of the mud-gas separator 190. As an alternative or as a supplement to the pump 260, the main line 261 also may be fluidicly connected to one or more rig pumps or other auxiliary pumps at the rig site.

The sensing and control system 222 (FIG. 3) includes valves, actuators, sensors, and a controller that manage the operation of the mud-gas separator 190. In some embodiments, the control is performed manually based on detected information, while in other embodiments, the control is performed automatically based on pre-stored settings.

FIG. 3 is a block diagram showing an example of the sensing and control system 222. The sensing and control system 222 includes sparge system valves 280, u-tube control valves 282, pressure sensors 284, a level transducer 286, a well return flow meter 288, and a controller 290 interconnected, for example as shown.

The sparge system valves 280 include in this exemplary embodiment, a series of valves, referenced as V1, V2, V3, V4, and V5, that control flow through the series of flow lines. These are also shown in FIG. 2. The valve V1 is disposed and configured to control flow through the primary flow line 262, the valve V2 is disposed and configured to control flow through the secondary flow line 264, the valve V3 is disposed and configured to control flow through the frusto-conical portion line 268, and the valve V4 is disposed and configured to control flow through the body portion flow line 270. The valve V5 is disposed and configured to control flow through the main line 261, controlling fluid access to the series of flow lines. An optional valve V6 controls flow from an alternative rig pump that would supplement or replace flow from the pump 260. Downstream of each of the valves V1, V2, V3, and V4 is an associated non-return or one-way valve 274 (FIG. 2) that prevents reverse flow through each of the flow lines.

These may be standard check valves, such as ball valves, proportional valves, or some other valves configured to permit fluid flow in only one direction. Depending on the embodiment, the valves may be manual, position indicated, or actuated, for example.

The u-tube control valves 282 are referenced in FIG. 3 and include valves V7 and V8 in FIG. 2, which are disposed to control flow through the primary and secondary u-tubes 212, 214, respectively. These valves V7, V8 may be proportional valves that may be controlled by the controller 290 in order to control and regulate flow through the main vessel 210.

The pressure sensors 284 are shown and referenced as PT1, PT2, PT3, and PT4. With reference to FIG. 2, the pressure sensor PT1 measures pressure in the primary u-tube 212. The pressure sensor PT2 measures pressure in the secondary u-tube 214. The pressure sensors PT1 and PT2 may be located at the lowest point of the respective U-tubes 212, 214. The pressure sensor PT3 measures pressure at the base of the frusto-conical portion 234. It may be disposed in the primary u-tube 212 adjacent the primary mud outlet 242 or at the bottom of the body portion 232. The pressure sensor PT4 is disposed above the typical fluid level of the main vessel 210 and is configured to measure vessel pressure of the main vessel 210.

The level transducer 286 is disposed within the body portion 232 and is configured to detect the level of fluid or mud within the main vessel 210. The level transmitter can be any of a variety of commercially available systems.

Embodiments having the well return flow meter 288 detect the flow of well returns into the main vessel 210. Accordingly, the flow or volume of mud and cuttings into the main vessel 210 may be controlled based on the detected flow, as deviations from expected flow may require operators to rectify flow control conditions. Monitoring the flow into the main vessel 210 may enable tracking and regulation to minimize the risk of an overflow by helping ensure that the main vessel 210 does not overflow.

The controller 290 may be configured to receive data from the pressure sensors 284, the level transducer 286, the well return flow meter 288, and/or a human-machine interface (HMI) 292, and based upon the received data, control the sparge system valves 280 and the u-tube control valves 282. The controller 290 may include a processor and memory. The processor may be, for example, an integrated circuit with power, input, and output pins capable of performing logic functions. In various embodiments, the processor may be a targeted device controller or a microprocessor configured to control the valves based on data received at the processor. It may receive and process data and may issue control signals to the sparge system valves 280, the u-tube control valves 282, the pump 260, or other components. The memory may be a semiconductor memory such as RAM, FRAM, or flash memory that interfaces with the processor. In some embodiments, the processor writes to and reads from the memory, and performs other common functions associated with managing semiconductor memory. The processor may read and execute control programs stored in the memory for the operation of the mud-gas separator 190. In some embodiments, the controller 290 is associated with or forms a part of the control system 200 in FIG. 1. The controller 290 may have stored therein fluid level thresholds used to control the operation mud-gas separator 190. In addition, the controller 290 may be configured to calculate fluid levels from data received from sensors, such as pressure sensors or load sensors.

The fluid level thresholds stored in the controller 290 may be pre-programmed during initial manufacturing or may be set by the operator based on the well plan, the terrain type, and based on other factors, including expected well control parameters. The thresholds may include a high threshold and a low threshold, but also may include multiple high and low thresholds. The controller 290 may be configured to create different alerts or take different actions for each threshold. In some embodiments, these fluid level thresholds correspond to the specific size of the mud-gas separator 190, while in other embodiments they can correspond to desired fluid level percentages based on the entire volume or based on a fluid height level in the mud-gas separator 190 or separation zone.

Some embodiments include data storage 294 separate from the controller 290, although some embodiments include the data storage 294 as a part of the memory of the controller 290. The data storage 294 may be a database, and the controller 290 may write to and read from the data storage 294, and may perform other common functions associated with managing the data storage. The controller 290 may read and execute control programs stored in the data storage for the operation of the mud-gas separator 190. In some embodiments, the data storage 294 receives and stores information relating to detected parameters, operation of the mud-gas separator 190, and/or other aspects of the drilling rig.

The HMI 292 provides feedback of data to an operator and allows an operator to input parameters and configurations. In some embodiments, the mud-gas separator 190 operates at least in part based on inputs at the HMI 292. The HMI 292 may include a display and one or more input mechanisms, such as a keypad, keyboard, a mouse, buttons, dials, or other input devices. In some embodiments, the display is a touch screen display serving as both an input device and a display. The controller 290 may output operational information to the HMI 292, the data storage 294, or elsewhere, for analysis, monitoring, storage, or for other purposes.

The mud-gas separator 190 is arranged to operate on a continuous basis while drilling. That is, it may be used not only with well control processes, but also when continuously drilling. In addition, some embodiments of the mud-gas separator 190 are instrumented and provide feedback to the controller 290.

Figure 4:
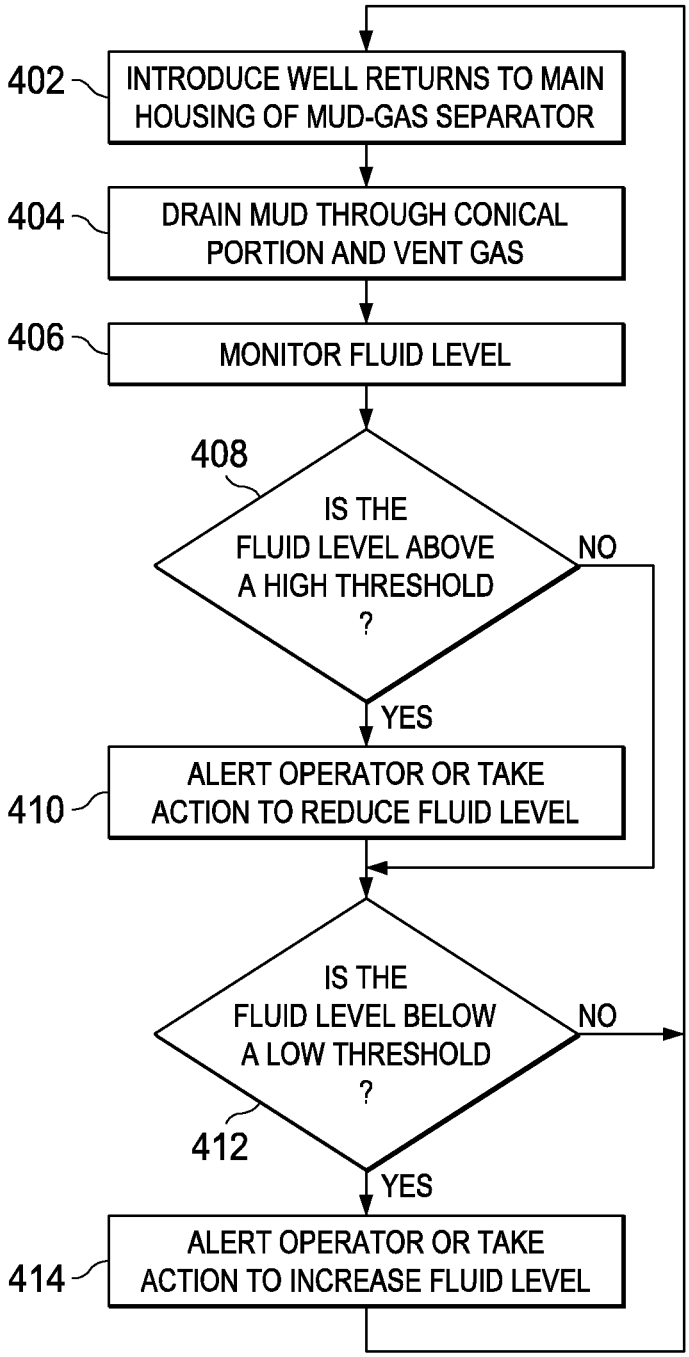
FIG. 4 is a flow chart showing an exemplary method according to one or more aspects of the present disclosure.

The operation of the mud-gas separator 190 is described below with reference to the flow chart 400 of FIG. 4. FIG. 4 begins at a step 402, with the introducing of well returns through one or more well return inlets 240 into the main vessel 210. As indicated above, the main vessel 210 includes a chamber that serves as a separation zone where returned gas may separate from returned mud and cuttings. The sloping wall(s) of the frusto-conical portion 234 guide the mud and cuttings to the primary mud outlet 242 at the bottom of the frusto-conical portion 234. At a step 404, the mud and cuttings flow through the primary mud outlet 242 and into the primary u-tube 212, on their way to the shakers 195. Also at the step 404, the gas from the well returns is vented through the upper portion of the main vessel 210 to atmosphere or to a flare tank or other location.

During operation of the mud-gas separator 190, as indicated by a step 406, the sensing and control system 222 continuously monitors the fluid level within the main vessel 210 or in the separation zone and the pressures for high fluid level or over-pressure conditions. At step 408, the controller 290 queries whether the fluid level exceeds a high preset fluid level threshold for the main vessel 210 or the separation zone. This threshold may be stored within the controller 290, may be set by the operator or during initial manufacturing, or any combination thereof. If at step 408 the fluid level does exceed the preset high threshold, then the method proceeds to a step 410.

At step 410, the controller 290 alerts an operator or takes action to reduce the fluid level in the main vessel 210 or the separation zone. To alert the operator, the controller 290 may activate, for example, a visual or audible indicator. In some embodiments, the indicator is a flashing light, such as an LED bulb, and in other embodiments, the indicator is an alert on an operator user interface that indicates that the fluid level exceeds the high threshold. In some embodiments, the alert signals the operator to take action to avoid an overflow condition. This may include decreasing the fluid level in the main vessel 210 or the separation zone. The operator may do this by controlling, either manually or by initiating instructions to the controller 290, the u-tube control valves 282, or the sparge system 216. In some cases the controller 290 controls the reaction automatically.

In some instances, the operator may open the secondary control valve V8 to allow flow through the secondary u-tube 214 to avoid the overflow condition. The secondary u-tube 214 may also be opened in emergency flooding conditions or as a backup during well control.

In some instances, the fluid level exceeding the high threshold level may indicate that the flow through the primary u-tube 212 is slower than desired to keep up with the flow into the main vessel 210 or within the separation zone. This may be a consequence of cuttings not having sufficient transport velocity to pass beyond the primary bend in u-tube 212. As such, they may fall to the bottom of the tube and occlude the tube. Therefore, in some instances, the operator may respond by controlling the sparge system 216 to inject high pressure clean fluid through the primary u-tube 212 to loosen and remove blockages from the primary u-tube 212. Fluid also may be added at the body portion line 270 to provide increased cutting transport velocity. This may help keep solids from collecting, unplug a blockage, or may add extra fluid to transport cuttings to minimize the risk of plugging. When the fluid level falls back below the high threshold level, the controller 290 may close the secondary control valve V8. This may help ensure that gas is not inadvertently allowed to pass through the secondary u-tube 214 to the shakers. While described as the operator taking action, in some embodiments, the controller 290 automatically responds by controlling the valves in the manner described to ensure that an overflow/underflow condition does not occur. In some embodiments, the controller may also alert a human operator that further analysis and/or further action may be required.

If at step 408 the fluid level in the main vessel 210 or the separation zone is not above the high fluid level threshold, then the method proceeds to step 412, where the controller 290 determines whether the fluid level is below a preset threshold. If the fluid level is below a preset threshold, then the controller 290 operates to either alert the operator to take corrective action or takes corrective action itself, as at a step 414.

The controller 290 may alert the operator with an indicator in the manner described above, or may take action itself. The fluid below a low threshold may indicate a low mud or fluid condition in the main vessel 210 or in the separation zone. In order to avoid pushing gas through the primary or secondary mud outlets 242, 244, the operator or the controller 290 may close the primary control valve V7 so that the gas is forced to exit through the gas vent 246 and not through the u-tubes 212. In addition, the controller 190 may activate the sparge system 216 to add additional fluid into the main vessel 210 through one or both of the valves V3 and V4.

After corrective action, when the fluid level again becomes higher than the low threshold, the controller 290 may again open or be instructed to open the control valve V7 to again allow flow through the primary u-tube 212. This may help maintain the fluid level within a desired range that provides a suitable operation enabling separation of gas and mud before the gas arrives at the shakers.

The alert to the operator may also enable the operator to take other well control actions to ensure that the well control is properly balanced with the proper amount of mud and being pumped into the wellbore.

If at step 412, the fluid level is not below a low threshold, then the method returns to the beginning and continuously monitors by performing the method again. Likewise, after taking corrective action, the method still returns to the beginning and continuously monitors fluid levels. In some embodiments, the controller does not operate the valves during certain drilling conditions.

Determining the fluid levels at step 406 may include direct measurement using the fluid level transducer 286 or using other sensors, including the pressure sensors 284 to calculate a secondary or redundant fluid level measurement. Density of the fluid and head pressure allows a secondary check on the level transducer 286, providing a redundant fluid level check. In some embodiments, the pressure sensors 284 measure pressure directly, while in other embodiments, fluid level is measured using load cells and calculations or radar transmitters. Based on data detected by the sensors, the controller 290 may warn of problems or failures of the primary measurement device, which is the level transducer 286.

If plugging appears to occur within the frusto-conical portion, the sparge system 216 may inject fluid into the frusto-conical portion line 268. This may help flush solids and keep mud and cuttings moving through the primary mud outlet 242. As indicated above, in some instances the pump 260 is supplemented by or replaced with a rig pump or other auxiliary pump. The lines are designed to have a nozzle effect, a cyclone effect, or both, to clean sides of the frusto-conical portion and keep the cuttings moving. In addition, well operators may operate the sparge system 216 during routine maintenance to remove build-up of mud or cuttings in the man vessel 210 and/or the primary or secondary u-tubes 212, 214. A conventional cleaning fluid, as distinct from a clean fluid, may be used by the sparge system 216 during maintenance and then flushed from the system before further use.

In some embodiments, the controller 290 monitors the flow and possibly density of the well returns into the main vessel 210 with the well return flow meter 288. If the controller 290 detects that the well return flow is insufficient to maintain cutting transport velocity through the primary u-tube 212, the controller 290 may automatically activate the pump 260 and open one or more of the valves V3, V4 to provide supplementary pressure and flow through the primary u-tube 212 and/or secondary u-tube 214 in order to maintain suitable velocity through the u-shape so that cuttings do not become entrapped. In some embodiments, the pump 260 is controlled with an on/off/auto configuration where it may be manually controlled to be automatically operated when in auto mode.

As indicated above, while not described in detail, the main vessel 210 may include multiple inlets and may include conventional gas busting internal elements, such as agitators, for example. Conventional fluid diverters and gas demisters can also be used.

In view of all of the above and the figures, one of ordinary skill in the art will readily recognize that the present disclosure introduces an apparatus including a main vessel including a frusto-conically shaped bottom portion and a side portion; a gas vent associated with the main vessel and configured to controllably vent gas from well returns introduced into the main vessel. The apparatus may also include a first mud outlet formed within the frusto-conically shaped bottom portion of the main vessel and configured to pass mud from well returns introduced into the main vessel; and a second mud outlet formed within the side portion of the main vessel and configured to pass mud from well returns introduced into the main vessel.

In an aspect, the apparatus includes a first u-tube connected to and extending from the first mud outlet toward a shaker; and a second u-tube connected to and extending from the first mud outlet toward a shaker. In an aspect, the apparatus includes a sparge system associated with the first u-tube and configured to introduce high pressure fluid into the first u-tube from a location upstream of a bottom of the first u-tube. In an aspect, the apparatus includes a sparge system configured to introduce high pressure fluid into the main vessel to increase a flow of fluid in the main vessel. In an aspect, the apparatus includes a sensing system configured to determine a fluid level within the main vessel, the sensing system being configured to alert an operator to a high fluid level condition or make automated control decisions. In an aspect, the apparatus includes a sensing system configured to determine a fluid level within the main vessel, the sensing system being configured to alert an operator to a low fluid level condition. In an aspect, the apparatus includes a sensing system configured to determine a fluid level within the main vessel, the sensing system being arranged to perform at least one of: closing a primary valve to reduce drainage from the main vessel through the first mud outlet, and opening a secondary valve to increase drainage flow through the second mud outlet. In an aspect, the sensing system comprises a fluid level transmitter configured to detect fluid levels in the main vessel. In an aspect, the sensing system comprises pressure sensors configured to indicate pressure differentials to determine a fluid level in the main vessel. In an aspect, the main vessel comprises a tapered bottom portion sloping toward the first mud outlet in a manner that directs mud and cuttings of the well returns to the first mud outlet.

The present disclosure also introduces a method including: introducing well returns into a separation zone; monitoring a fluid level within the separation zone; controlling a first valve to reduce flow through a bottom of the separation zone when the fluid level is below a threshold; and controlling a second valve to increase flow through a side of the separation zone when the fluid level is above a threshold.

In an aspect, monitoring a fluid level within the separation zone comprises detecting the fluid level with a level transducer. In an aspect, monitoring a fluid level within the separation zone comprises detecting a pressure differential with at least a pair of pressure sensors and determining based on the pressure differential and density whether a fluid level is above or below a stored threshold level. In an aspect, the method includes venting gas from the well returns through a gas vent disposed in an upper portion of the separation zone; and flowing mud from the well returns through a first mud outlet disposed at the bottom of the separation zone into a u-shaped outlet zone. In an aspect, the method includes injecting a high pressure fluid into the u-shaped outlet zone to increase the fluid velocity through the u-shaped outlet zone. In an aspect, the method includes injecting a high pressure fluid into a frusto-conical portion of the separation zone to increase the flow through the bottom of the separation zone. In an aspect, the method includes directing mud from the well returns through a mud outlet disposed at a bottom of a sloping side portion of the separation zone. In an aspect, the sloping side portion forms a frusto-conical portion of the separation zone leading to the mud outlet.

The present disclosure also introduces an apparatus including a main vessel configured to receive well returns; a gas vent associated with the main vessel and configured to vent gas from the well returns; a first mud outlet formed within the main vessel and configured to vent mud from well returns introduced into the main vessel; and a second mud outlet formed within main vessel and configured to vent mud from well returns introduced into the main vessel, wherein the first mud outlet and the second mud outlet are disposed at different elevations within the main vessel.

In an aspect, the apparatus includes a first u-tube connected to and extending from the first mud outlet toward a shaker; and a second u-tube connected to and extending from the first mud outlet toward a shaker. In an aspect, the apparatus includes a sparge system associated with the first u-tube and configured to introduce high pressure fluid into the first u-tube at a location upstream of a bottom of the first u-tube. In an aspect, the apparatus includes a sensing system configured to determine a fluid level within the main vessel, the sensing system being configured to perform at least one of: closing a primary valve to reduce drainage from the main vessel through the first mud outlet, and opening a secondary valve to increase drainage flow through the second mud outlet.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112(f) for any limitations of any of the claims herein, except for those in which the claim expressly uses the word "means" together with an associated function.

What is claimed is:

1. An apparatus, comprising:

a main vessel including a frusto-conical shaped bottom portion and a side portion;

a gas vent associated with the main vessel and configured to controllably vent gas from well returns introduced into the main vessel;

a first mud outlet formed within the frusto-conical shaped bottom portion of the main vessel and configured to pass mud from well returns introduced into the main vessel;

a second mud outlet formed within the side portion of the main vessel and configured to pass mud from well returns introduced into the main vessel; and a sparge system configured to introduce high pressure fluid into the main vessel to increase a flow of fluid in the main vessel.

2. The apparatus of claim 1, comprising:

a first u-tube connected to and extending from the first mud outlet toward a shaker; and a second u-tube connected to and extending from the second mud outlet toward a shaker.

3. The apparatus of claim 2, comprising a sparge system associated with the first u-tube and configured to introduce high pressure fluid into the first u-tube from a location upstream of a bottom of the first u-tube.

4. The apparatus of claim 1, comprising:

a sensing system configured to determine a fluid level within the main vessel, the sensing system being configured to alert an operator to a high fluid level condition or make automated control decisions.

5. The apparatus of claim 1, comprising:

a sensing system configured to determine a fluid level within the main vessel, the sensing system being configured to alert an operator to a low fluid level condition.

6. The apparatus of claim 1, comprising a sensing system configured to determine a fluid level within the main vessel, the sensing system being arranged to perform at least one of:

closing a primary valve to reduce drainage from the main vessel through the first mud outlet, and opening a secondary valve to increase drainage flow through the second mud outlet.

7. The apparatus of claim 6, wherein the sensing system comprises a fluid level transmitter configured to detect fluid levels in the main vessel.

8. The apparatus of claim 6, wherein the sensing system comprises pressure sensors configured to indicate pressure differentials to determine a fluid level in the main vessel.

9. The apparatus of claim 1, wherein the main vessel comprises a tapered bottom portion sloping toward the first mud outlet in a manner that directs mud and cuttings of the well returns to the first mud outlet.

10. A method comprising:

introducing well returns into a separation zone;

monitoring a fluid level within the separation zone;

controlling a first valve to reduce flow through a bottom of the separation zone when the fluid level is below a threshold;

controlling a second valve to increase flow through a side of the separation zone when the fluid level is above a threshold; and controlling a sparge system configured to introduce high pressure clean fluid into the separation zone to increase a flow of fluid in the separation zone when additional fluid is desired in the separation zone.

11. The method of claim 10, wherein monitoring a fluid level within the separation zone comprises detecting the fluid level with a level transducer.

12. The method of claim 10, wherein monitoring a fluid level within the separation zone comprises detecting a pressure differential with at least a pair of pressure sensors and determining based on the pressure differential and density whether a fluid level is above or below a stored threshold level.

13. The method of claim 10, comprising:

venting gas from the well returns through a gas vent disposed in an upper portion of the separation zone; and flowing mud from the well returns through a first mud outlet disposed at the bottom of the separation zone into a u-shaped outlet zone.

14. The method of claim 13, comprising injecting a high pressure fluid into the u-shaped outlet zone to increase the fluid velocity through the u-shaped outlet zone.

15. The method of claim 13, comprising injecting a high pressure fluid into a frusto-conical portion of the separation zone to increase the flow through the bottom of the separation zone.

16. The method of claim 10, comprising directing mud from the well returns through a mud outlet disposed at a bottom of a sloping side portion of the separation zone.

17. The method of claim 16, wherein the sloping side portion forms a frusto-conical portion of the separation zone leading to the mud outlet.

18. An apparatus, comprising:

a main vessel configured to receive well returns;

a gas vent associated with the main vessel and configured to vent gas from the well returns;

a first mud outlet formed within the main vessel and configured to vent mud from well returns introduced into the main vessel;

a second mud outlet formed within main vessel and configured to vent mud from well returns introduced into the main vessel, wherein the first mud outlet and the second mud outlet are disposed at different elevations within the main vessel; and a sparge system configured to introduce high pressure fluid into the main vessel to increase a flow of fluid in the main vessel.

19. The apparatus of claim 18, comprising:

a first u-tube connected to and extending from the first mud outlet toward a shaker; and a second u-tube connected to and extending from the second mud outlet toward a shaker.

20. The apparatus of claim 19, comprising:

a sparge system associated with the first u-tube and configured to introduce high pressure fluid into the first u-tube at a location upstream of a bottom of the first u-tube.

21. The apparatus of claim 18, comprising a sensing system configured to determine a fluid level within the main vessel, the sensing system being configured to perform at least one of:

closing a primary valve to reduce drainage from the main vessel through the first mud outlet, and opening a secondary valve to increase drainage flow through the second mud outlet.

* * * * *